United States Patent [19]

Hagen

[11] Patent Number: 4,866,966

[45] Date of Patent: Sep. 19, 1989

[54] METHOD AND APPARATUS FOR PRODUCING BYPASS GROOVES

[75] Inventor: Robert A. Hagen, Blissfield, Mich.

[73] Assignee: Monroe Auto Equipment Company, Monroe, Mich.

[21] Appl. No.: 237,842

[22] Filed: Aug. 29, 1988

[51] Int. Cl.[4] ..... B21D 17/04

[52] U.S. Cl. ..... 72/75; 72/113; 72/208

[58] Field of Search ..... 72/75, 208, 370, 113, 72/120

[56] References Cited

U.S. PATENT DOCUMENTS

| | | | |
|---|---|---|---|
| 372,081 | 10/1887 | Nebergall et al. . | |
| 376,057 | 1/1888 | Allen . | |
| 465,957 | 12/1891 | Willmott . | |
| 629,245 | 7/1899 | Frank | 72/75 |
| 649,341 | 5/1900 | Nevill . | |
| 943,907 | 12/1909 | Austin . | |
| 1,494,128 | 5/1924 | Primrose . | |
| 1,774,231 | 8/1930 | Harnsberger . | |
| 1,799,872 | 4/1931 | Seipel . | |
| 1,828,383 | 10/1931 | Andersen . | |
| 1,840,103 | 1/1932 | Junkers . | |
| 1,998,552 | 4/1935 | Mautsch . | |
| 2,319,216 | 5/1943 | Dewald . | |
| 2,409,219 | 10/1946 | Maxwell . | |
| 2,620,012 | 12/1952 | Walsh . | |
| 2,625,065 | 1/1953 | Trishman . | |
| 2,690,205 | 9/1954 | Stary . | |
| 3,188,850 | 6/1965 | Linthicum et al. . | |
| 3,203,483 | 8/1965 | Vincent . | |
| 3,221,528 | 12/1965 | Linthicum et al. . | |
| 3,357,229 | 12/1967 | Luedi . | |
| 3,358,492 | 12/1967 | Richter . | |
| 3,376,725 | 4/1968 | Andrews . | |
| 3,470,724 | 10/1969 | Gregg . | |
| 3,499,505 | 3/1970 | Carbon . | |
| 3,640,115 | 2/1972 | Duncan et al. | 72/75 |
| 3,782,157 | 1/1974 | Foulks et al. . | |
| 3,877,282 | 4/1975 | Pogonowski . | |
| 4,309,891 | 1/1982 | Pogonowski . | |
| 4,643,011 | 2/1987 | Wossner et al. . | |

FOREIGN PATENT DOCUMENTS

| | | | |
|---|---|---|---|
| 2741799 | 2/1978 | Fed. Rep. of Germany . | |
| 2482484 | 11/1981 | France . | |
| 202920 | 11/1983 | Japan | 72/113 |

OTHER PUBLICATIONS

The Next Step In Exhaust Tuning: Yamaha Exup, May 1988, *Cycle*-(Magazine), Mike Bethell's 5 yr. Plan, Oct. 26, 1987.

*Primary Examiner*—Lowell A. Larson
*Attorney, Agent, or Firm*—Harness, Dickey, Pierce

[57] ABSTRACT

The present invention is directed to a method and apparatus for simultaneously producing multiple linear grooves on the internal surface of cylindrical tubes. The apparatus comprises an outer cage assembly with a mandrel assembly axially and slideably disposed therein. Additionally, each assembly is capable of independent nonrotational linear motion. The cage assembly is introduced into the inner diameter of the tube along their common cylindrical axis. A multiplicity of spherical roller elements, retained within circumferentially spaced ports near the entry end of the cage assembly maintain resting contact with the mandrel assembly disposed within the cage assembly. The entry end of the mandrel assembly is conically tapered to define a range of radial motion for the rollers upon linear movement of the mandrel assembly. This linear movement of the mandrel assembly generates radial expansion of the circumferentially spaced rollers into pressing contact with the pressure tube. Thereafter, linear nonrotational movement of the cage assembly defines the length of the linear grooves made by the rolling motion of the rollers upon maintained radial expansion. Variable radial expansion during motion of the cage assembly permits production of the grooves having tapered geometric profiles.

40 Claims, 3 Drawing Sheets

METHOD AND APPARATUS FOR PRODUCING BYPASS GROOVES

BACKGROUND OF THE INVENTION

1. Field of the Invention

This invention relates to the manufacturing of vehicle suspension components, and more particularly, to a method and apparatus for producing linear grooves on the inner diameter wall of cylindrical tubes.

2. Description of the Related Art

A conventional damping device, such as a shock absorber or suspension strut, comprises a cylindrical pressure tube. Surrounding the pressure tube is a coaxially disposed reservoir tube. Located on the inner wall surface of the cylindrical pressure tube are linear grooves which define fluid flow paths. The grooves allow damping fluid to communicate between the two fluid chambers within the pressure tube defined by the opposite sides of a piston. Variations in the groove depth, width, length and a combination thereof, define the volumetric fluid flow around the piston, thereby developing the damping characteristics of the device. Proper damping characteristics mandate accurate and repeatable groove locational, dimensional and angular control during the forming process.

Methods previously utilized to produce linear grooves in the inner diameter of cylindrical tubes include machining and expanding tool devices. Grooves produced by machining operations tend to generate undesirable sharp-edged groove transitions and burrs. Groove profiles of variable sectional geometries require multiple machining operations and tool sets to produce. Accordingly, machining is not readily adaptable to high volume production environments.

The expanding tool method allows for radial expansion of a grooving anvil into contact with the inner diameter of a cylindrical tube. The expanded anvil is then forcibly pushed or pulled through the tube along its cylindrical axis. Movement of the unit generates flow of the pressure tube wall into the groove profile defined by the anvil tool. This process is not capable of producing grooves of variable cross-sectional geometries. Substantial forming pressures are also required.

A further method of forming a pressure groove is disclosed in U.S. Pat. No. 4,643,011. In this reference, the cylindrical pressure tube is introduced into a cylindrical support member. The support member contains predefined receiving grooves on its inner diameter. A roller member having a rolling axis perpendicular to the pressure tube cylindrical axis is introduced into the inner diameter of the pressure tube. The roller member has a radially projecting elevation that is angularly aligned with the receiving groove in the support member. As the roller member travels through the length of the pressure tube, the elevation is pressingly urging the pressure tube wall thickness into the mating support member receiving groove. The grooves are formed by embossing the pressure tube wall thickness into the receiving grooves of the external support member. This method often requires special support member for different groove profiles. Additionally, simultaneous production of multiple grooves circumferentially located within the pressure tube is generally not possible. Further, significant forming pressures are often required by this method.

SUMMARY OF THE INVENTION

Accordingly, it is the primary object of the present invention to provide a method and apparatus for simultaneously producing multiple pressure tube grooves with the potential to generate variability in groove depth, width, length and combinations thereof.

Another object of the present invention is to provide a method for generating nonrotational linear motion of the apparatus for simultaneously producing multiple linear grooves in a production environment.

A further object of the present invention is to eliminate the necessity of special tool sets for corresponding changes to a particular groove profile. A related object of the present invention is to provide an apparatus which has the inherent dynamic adjustment capability to simultaneously produce grooves in cylindrical tubes which have a range of inner diameters and tubular lengths.

Additionally, it is another object of the present invention to provide an apparatus which has the inherent dynamic adjustment capability to simultaneously produce grooves which have a range of depths, lengths and combinations thereof to produce full and tapered cross-sectional groove impression profiles.

Specifically, the apparatus according to the present invention includes a tool having a cylindrical cage sleeve and cage which are secured to define a nonrotational cage assembly. Disposed axially and slideably within the cage assembly is a mandrel and conically tapered mandrel tip which are nonrotationally secured independent of the cage assembly. Further, three retaining ports are provided through the cylindrical cage sleeve located at 120° intervals within the same circumferential plane, and which are perpendicular to the cylindrical axis of the cage assembly. A spherical roller is positioned in each cage sleeve retaining port thereby radially engaging the tapered surface of the mandrel tip which is axially disposed within the inner passage of the cage sleeve. The spherical rollers are restricted under tension within the cage sleeve retaining ports by a cylindrical spring sleeve that mounts on the outer surface of the cage sleeve. The cylindrical spring sleeve has three holes of identical angular orientation to those of the cage sleeve retaining ports. The diameter of the spring sleeve holes is slightly less than that of the spherical rollers. The spring sleeve, mounted over the spherical rollers positioned within the cage sleeve retaining ports and resting on the mandrel tip, permits limited radial motion of the spherical balls. The cage assembly and mandrel assembly are individually or simultaneously capable of linear nonrotational motion. Linear motion of the cage assembly determines the length of the groove impression. Linear motion of the mandrel assembly produces a corresponding range of radial motion of the spherical rollers thereby defining the groove depth and width dimensions.

The apparatus is further defined by the cylindrical cage assembly and cylindrical mandrel assembly each being actuated by any known method for producing reciprocating linear nonrotational motion. The entire apparatus is then controlled by any known programmable controller system.

According to the method of the present invention, the cage assembly with the mandrel assembly axially located therein, is introduced into the inner diameter of a positively located cylindrical pressure tube along its axis. Monitorization and control of the nonrotational linear motion of the cage assembly and mandrel assembly, whether independently or simultaneously actuated, is accomplished by the pre-programmed controller device. The linear motion of the mandrel assembly translates into a definable range of radial motion for the spherical rollers. The radial motion is generated by the spherical rollers engagingly following the tapered profile of the mandrel tip during its linear actuation. The controlled motion of the mandrel assembly determines the radial position of the spherical balls thereby defining the radial forces exerted on the pressure tube inner wall during the groove forming operation. Upon engagement of the rollers with the pressure tube, the cage assembly is actuated to produce nonrotational linear motion, whereby the rollers maintain radial rolling pressure on the pressure tube inner wall and generate the desired groove length. Variable actuation of the mandrel assembly during the linear motion of the cage assembly will produce groove depth and width variations in relation to the groove length.

Thus, the present invention allows for accurately producing multiple grooves simultaneously with the dynamic capability to instantaneously produce variable groove profiles without special tooling sets or the related time consuming change-over requirements. Complex groove profiles can be produced during one rolling operation thereby eliminating the need for multiple progressive operations. It is contemplated, however, that a secondary operation may be utilized to correct any out-of-round conditions generated during the groove rolling operation. The secondary operation encompasses any method, such as passing a tool device through the pressure tube along its cylindrical axis, capable of correcting an out-of-round condition. this invention also incorporates utilization of nonrotational radial rolling forces to produce the grooves which significantly reduces working pressure requirements. Said invention exhibits superior dimensional accuracy and repeatability and is readily adaptable to production-type environments.

BRIEF DESCRIPTION OF THE DRAWINGS

Various advantages of the present apparatus and method invention will become apparent to one skilled in the art upon reading the following detailed description and by reference to the following drawings in which:

FIG. 3 is an enlarged side elevational view of the groove forming tool shown in FIG. 2 inserted into a cylindrical pressure tube prior to the groove forming operation;

FIG. 4 is an enlarged side elevational view of the groove forming tool shown in FIG. 2 during the groove forming operation;

DESCRIPTION OF THE PREFERRED EMBODIMENT

Figure 1:
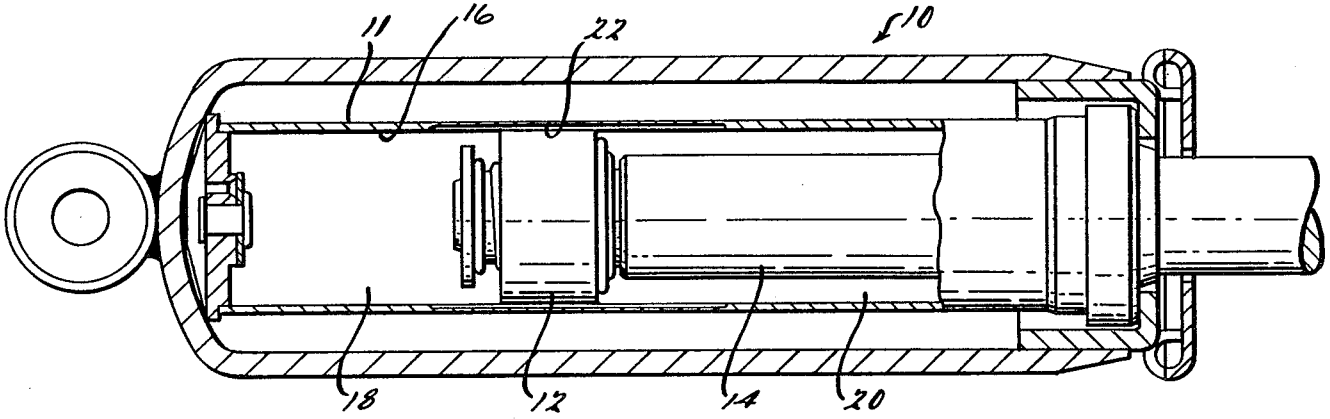
FIG. 1 is a side elevational view, partially broken away, of a shock absorber showing a grooved cylindrical inner tube.

Referring to FIG. 1, the basic configuration of a typical damping device 10 is shown. The damping device 10 may be used in conjunction with vehicular suspension systems to absorb unwanted vibration which occur during driving. The damping device 10 generally comprises an inner cylindrical pressure tube 11 in which a piston 12 and a rod 14 are axially and slideably disposed. The inner wall surface 16 of the pressure tube 11 defines fluid chambers 18 and 20 which are disposed on the opposite sides of the piston 12. The groove 22 formed according to the preferred embodiment of the present invention, is produced on the inner wall 16 of the pressure tube 11. Damping fluid is thereby permitted to flow between the working chambers 18 and 20 through the groove 22 during reciprocating motion of the damping device 10. The number of grooves 22, their location and their specific geometric profile determine in part the damping characteristics of the damping device 10.

Figure 2:
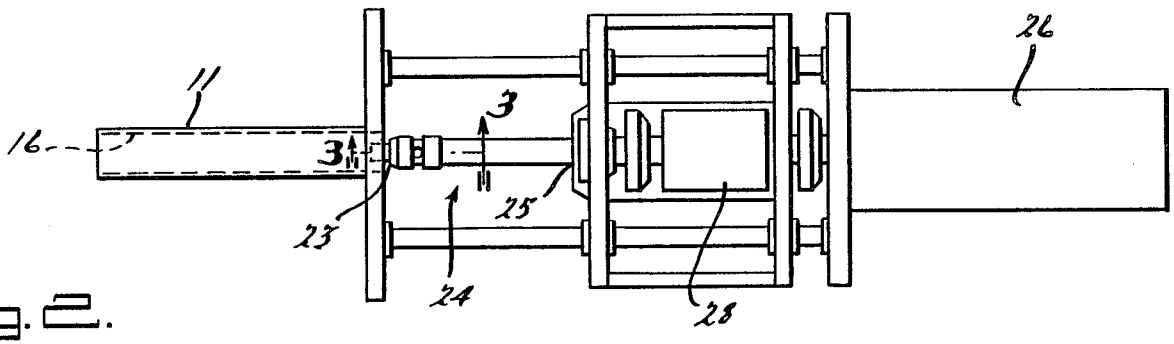
FIG. 2 is a plan view of the groove forming apparatus according to the preferred embodiment of the present invention, in operative association with typical reciprocating actuator devices.
Figure 2:
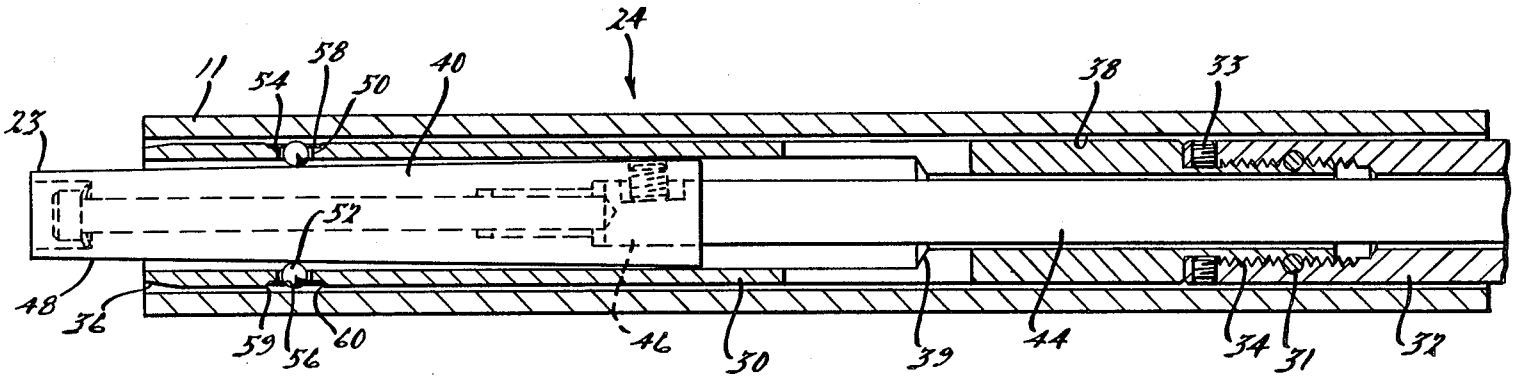
Figure 1:
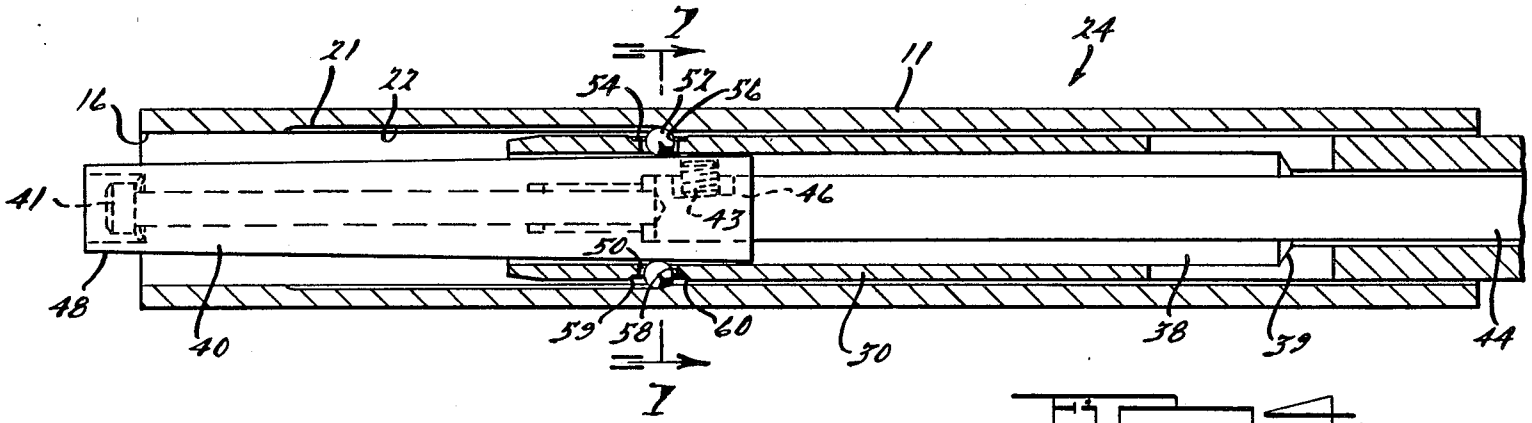

With reference to FIG. 2, an embodiment of the groove forming tool 24 is shown in operative association with externally connected actuation devices 26 and 28 capable of producing nonrotational linear motion. With the cylindrical pressure tube 11 being positively located, the cylindrical groove forming tool 24 is dynamically introduced into the inner diameter of the pressure tube 11. The actuation devices 26 and 28 can be any unit capable of reciprocating motion such as hydraulic or servo-hydraulic cylinders. The present invention is adaptable to be operatively associated with any known actuation and controller methods.

With particular reference to FIG. 3, the entry end portion 23 of the groove forming tool 24 is shown positioned within the inner diameter of the cylindrical pressure tube 11 prior to the groove forming operation. The tool 24 comprises a cylindrical cage sleeve 30 which is connectably affixed to a cylindrical cage 32 to create a continuous cylindrical cage assembly 34. The cylindrical length of the cage assembly 34 determines the maximum pressure tube lengths adaptable for groove forming operation. The cage assembly 34 is nonrotationally secured to a linear actuation device 26 at its drive end 25. The nonrotational aspects will be specifically discussed below. The mounting methods utilized are known in the art and provide standardization for efficient replacement efforts.

The cage sleeve 30 has a tapered annular entry edge 36 to assist in centrally positioning the cage assembly 34 within the inner diameter of the pressure tube 11 along its cylindrical axis. The cage sleeve 30 and cage 32 are threadably joined and secured with locking pins 31 and set screws 33 to define the two-piece cage assembly 34. Axially defined within the cage assembly 34 is a central passage 38. The cylindrical passage 38 has a constant diameter throughout the cage member 32. The passage 38 has a larger diameter within the entry end of the cage sleeve 30 which generates a annular shoulder 39 where the two different diameters of the cylindrical passage 38 meet.

Slideably disposed within the cage assembly 34 is the mandrel tip 40 and mandrel shank 44 defining a mandrel assembly 46. The mandrel tip 40 and mandrel shank 44 are co-extensively affixed to define the two-piece mandrel assembly 46. The mandrel tip 40 is completely disposed within the larger diameter section of the cylindrical passage 38 located within the cage sleeve 30. The mandrel assembly 46 is capable of linear nonrotational motion through the cage assembly 34. This linear motion is generated by mounting the mandrel assembly 46 to the independent second actuation device 28 at its drive end 25. This actuation device 28 is capable of generating nonrotational linear motion of the mandrel assembly 46 independent of the actuator device 26 that drives the cage assembly 34. The inner action and control of the independent actuators 26 and 28 is dynamically controlled by any programmable controller widely recognized in the art.

During introduction into the pressure tube 11, the mandrel assembly 46 is retractably positioned with the mandrel tip 40 being substantially contained within the cylindrical passage 38 of the cage sleeve 30. The mandrel tip 40 has a conically tapered outer surface 48. The conically tapered profile is defined by increasing diameters in the rearward direction toward the drive end 25. Passing through the cage sleeve 30 are three circumferentially spaced retaining ports 50. The retaining ports 50 are located within the same circumferential plane which is perpendicular to the cylindrical axis of the tool 24. The retaining ports 50 are angularly displaced by 120° to each other and at a predetermined orientation from true vertical which will be discussed in detail later.

Within each retaining port 50 is positioned a roller element 52. The roller elements 52 are confined within the retaining ports 50 by a cylindrical split spring sleeve 54. The spring sleeve 54 has radially aligned holes 56 of identical angular orientation to that of the retaining ports 50. The holes 56 have a diameter that is slightly smaller than that of the roller elements 52 so as to confine the roller elements 52 within the retaining ports 50. The spring sleeve 54 is positively located in a pilot diameter 58 on the outer diameter of the cage sleeve 30 defined by adjacent circumferential shoulders 59 and 60. The roller elements 52 confined within the retaining ports 50 by the spring sleeve 54 rollingly engage the conically tapered surface 48 of the mandrel tip 40, which is disposed axially within the passage 38 of the cage sleeve 30.

With the mandrel assembly 46 retracted toward the rearward drive end 25, the mandrel tip 40 is substantially located inside the cage sleeve 30. Accordingly, the roller elements 52 which are rollingly following the tapered surface 48 of the mandrel tip 40 are drawn radially downward. The radial motion of the rollers 52 is defined by the slope of the tapered surface 48 of the mandrel tip 40. The roller elements 52 are not in contact engagement with the inner diameter wall surface 16 as the tool 24 is introduced into the pressure tube 11.

With particular reference now to FIG. 4, the tool 24 during nonrotational linear actuation of the cage assembly 34 is shown. Upon proper location of the tool 24 within the pressure tube 11, the actuator device 28 generates forward linear motion of the mandrel assembly 46. This nonrotational motion of the mandrel tip 40 translates into outwardly expanding radial motion of the roller elements 52 which are following the tapered surface 48 of the mandrel tip 40. This expansion brings the roller elements 52 into pressing contact with the inner wall surface 16 of the pressure tube 11. The cage assembly 34 is then actuated by actuator device 26 to produce nonrotational linear motion.

As depicted in FIG. 4, the nonrotational linear motion of the cage assembly 34 is rearwardly directed toward the drive end 25. However, it should be observed that this invention is capable of forming grooves in either direction of linear motion of the cage assembly 34. Dynamic control of the linear travel of the mandrel tip 40 within the cage sleeve and the slope of its tapered surface 48 determines the range of radial motion possible. Further expansion of the roller elements 52 upon contact with the pressure tube 11 generates a groove impression 21 in the pressure tube 11 inner wall surface 16. The rearward linear motion of the cage assembly 34 allows rolling engagement of the roller elements 52 with the pressure tube 11 inner wall 16 thereby producing the desired groove. The radial rolling forces are evenly distributed around the tool 24 thereby minimizing the forces required to produce the grooves 22. The cylindrical components provide superior radial support and load bearing distribution. Each rolling member 52 produces identical and repeatedly accurate multiple grooves 22.

Figures 5, 6A, 6B, 6C, 6D, 6E, 6F, 7:
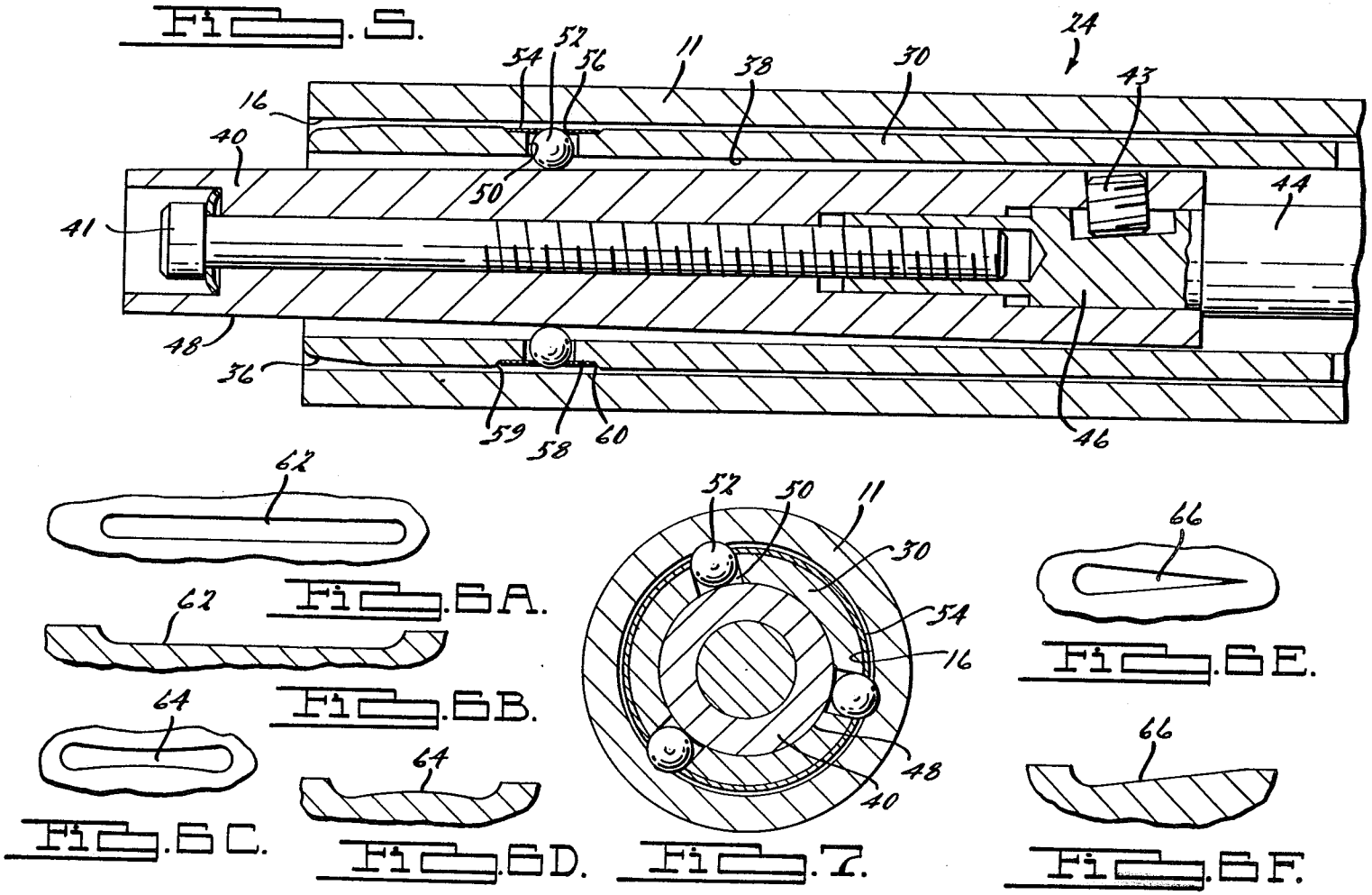
FIG. 5 is an enlarged side elevational view of the groove forming tool shown in FIG. 3 which illustrates the positional relationship of the nonrotational components as introduced into a cylindrical tube prior to groove forming.
FIGS. 6A through 6F depict possible groove profiles generated by the groove forming tool according to the preferred embodiment of the present invention.
FIG. 7 is a vertical sectional view of the radial orientation of the multiple rolling elements according to the preferred embodiment of the present invention.

FIG. 5 enlarges the view shown in FIG. 3 as well as providing detail of the efficient component replacement properties. The present invention embodies quick and efficient replacement of those components such as the roller elements 52 and the mandrel tip 40 which are susceptible to wear. It is contemplated within the fair meaning of this disclosure that an intermediate rolling surface having superior wear characteristics may be adapted to interface between the roller elements 52 and the tapered mandrel tip 40. Intermediate surfaces such as a sleeve mounted over the outer surface of the tapered mandrel tip 40 or installation of inserts on the mandrel tip 40 along the linear rolling path of the roller elements 52 are practical examples of what is contemplated.

With reference to FIG. 5, the mandrel tip 40 is secured to the mandrel shank 44 by a bolt 41 passing through the mandrel tip 40 along its cylindrical axis. A set screw 43 prevents the mandrel tip 40 from rotating. The roller elements 52 are quickly replaced by removing the split spring sleeve 54 from the pilot diameter 58 on the outer diameter of the cage sleeve 30. Upon replacement of the rolling elements 52, the split spring sleeve 54 is remounted to retain the rolling elements 52 within the retaining ports 50. Again this view shows the roller elements 52 rollingly sitting on the tapered profile 48 of the mandrel tip 40 while being retained by the spring sleeve 54 and the retaining ports 50 of the cage sleeve 30.

In particular reference to FIGS. 2, 4 and 6, the groove 22 is shown in typical form. The present invention adapted with programmable control of the actuation devices 26 and 28 is dynamically capable of automatically producing geometric profile variations within the groove 22. Actuation device 26 provides nonrotational linear motion to the cage assembly 34. Acutation device 28 generates nonrotational linear motion of the mandrel assembly 46 which proportionately translates into radial motion of the roller members 52. During the groove forming operation, controlled linear motion of the cage assembly 34 defines the length of the groove 22. Controlled linear motion of the mandrel assembly 46 determines the depth and width of the groove 22. Interaction of the two modes of linear motion produce grooves 22 of variable groove profiles. FIGS. 6-A and 6-B represent a nonvariable groove profile 62 of constant width and depth. FIGS. 6-C and 6-D represent a groove profile 64 that is generated by bidirectional linear nonrotational motion of the mandrel assembly 46 during linear nonrotational motion of the cage assembly 34. FIGS. 6-E and 6-F represent a variable groove profile 66 that is generated by unidirectional linear nonrotational motion of the mandrel assembly 46 during linear nonrotational motion of the cage assembly 34. The resultant groove profiles 64 and 66 depict the capability to generate variable geometric profiles pursuant to the direction and degree of nonrotational lineary motion of the mandrel assembly 46 during concurrent nonrotational linear motion of the cage assembly 34.

Referring now to FIG. 7, the vertical section defined in FIG. 4 through the roller elements 52 is shown. The multiple retaining ports 50 through the cage sleeve 30 are angularly oriented around the circumference of the cage sleeve 30 so as to produce multiple grooves.

The roller elements 52 are angularly aligned counterclockwise of true vertical position to allow efficient ejection of the tool 24 from within the pressure tube 11 upon completion of the grooving operation. The linear nonrotational motion generated by the actuation devices 26 and 28 determines the final groove impression 22 produced by the tool 24. The tool 24 provides superior radial support during the rolling operation thereby permitting the production of three grooves 22 simultaneously having repeatable dimensional accuracy. The invention is readily adaptable to a high volume production environment where its significant advantages will be apparent. Specifically, the tool 24 eliminates the necessity of specialized tooling sets for each different groove profile. Groove profile changes are accomplished automatically without any downtime for tooling change-over. Additionally, the invention's ability to produce multiple and variable groove profiles during a single rolling operation also improves over previous methods which required multiple operations.

While it will be apparent that the preferred embodiment of the invention disclosed are well calculated to fulfill the objects above stated, it will be appreciated that the invention is acceptable to modification, variation and change without departing from the proper scope or fair meaning of the invention.

What is claimed is:

1. An apparatus for producing linear grooves on the inner wall of cylindrical tubes comprising:

a plurality of roller elements;

a cage assembly having an internal passage;

a mandrel assembly slideably disposed within said internal passage of said cage assembly, said mandrel having a tapered end seciton;

port means through said cage assembly, for permitting mechanical communication between said roller elements disposed within said port means and said tapered end section of said mandrel assembly;

means for retaining said roller elements within said port means, said means for retaining permitting radial motion of said roller elements;

first actuation means for producing linear nonrotational reciprocating motion of said cage assembly;

second actuation means for producing linear nonrotation reciprocating motion of said cage assembly, said second actuation means generating radial expansion of said roller elements into pressing contact with said cylindrical tube inner walls thereby producing said grooves therein; and control means for controlling said first and second actuation means for producing groove profile variations during linear nonrotational reciprocating motion of said cage assembly and said radial expansion of said roller elements.

2. The apparatus according to claim 1, wherein said port means is a plurality of retaining ports through said cage assembly, said retaining ports radially aligned within the same peripheral plane which is perpendicular to the central axis of said cage assembly.

3. The apparatus according to claim 1, wherein said means for retaining said roller elements within said port means is a split spring sleeve, said split spring sleeve mountable on the outer surface of said cage assembly.

4. The apparatus according to claim 1, wherein said first actuation means for producing linear nonrotational motion of said cage assembly comprises said cage assembly being operatively coupled to a first reciprocating actuation device.

5. The apparatus according to claim 1, wherein said second actuation means comprises said mandrel assembly being operatively associated with a second reciprocating actuation device, said second reciprocating actuating device producing linear nonrotational motion of said mandrel assembly.

6. The apparatus according to claim 5, wherein said linear nonrotational motion of said mandrel assembly generates rolling motion of said roller elements along the surface of said tapered section of said mandrel assembly.

7. The apparatus according to claim 6, wherein said rolling motion along said tapered mandrel section produces radial motion proportional to the slope of said tapered mandrel section.

8. The apparatus according to claim 7, wherein outward radial motion of said roller elements generates pressing contact with the inner walls of said tube member, thereby creating mechanical rolling communicatin between said roller elements and the inner wall of said tube member, the amplitude and direction of said radial motion defining the depth and width of said groove produced therein.

9. The apparatus according to claim 1, wherein said means for producing groove profile variations during operations of said apparatus is defined by providing variable linear nonrotational motion of said mandrel assembly during linear nonrotational motion of said cage assembly.

10. The apparatus according to claim 9, wherein variable linear nonrotational motion of said mandrel assembly, upon mechanical rolling contact of said roller elements with the inner wall of said tube member, translates into variable radial motion of said roller elements thereby developing variable groove profiles.

11. An apparatus for producing multiple linear grooves on the inner wall of cylindrical tubes comprising:

a cage member having an internal passage extending through its length, said passage centrally aligned with the cylindrical axis of said cage member;

a cage sleeve having an axially aligned passage, said cage sleeve co-extensively connected to said cage member thereby creating a cage assembly having a continuous internal passage therein;

a mandrel shank axially and slideably disposed within said passage of said cage assembly;

a tapered mandrel tip co-extensively connected to said mandrel shank to create a mandrel assembly, said mandrel tip axially and slideably disposed exclusively within a central passage of said cage sleeve;

a plurality of retaining ports through said cage sleeve, said retaining ports aligned within the same circumferential plane which is perpendicular to the cylindrical axis of said cage sleeve;

a plurality of roller elements individaully positioned within said retaining ports of said cage sleeve, said rolling elements rollingly engaging said tapered mandrel tip disposed within said cage sleeve;

means for retaining said roller elements within said retaining ports to maintain resting contact of said roller elements within said tapered mandrel tip;

actuation means for producing nonrotational linear motion of said cage assembly and said mandrel assembly; and control means for selectively controlling said actuation means to produce variable groove profiles during operation of said tool.

12. The apparatus according to claim 11, wherein said roller elements are in the form of a spherical ball.

13. The apparatus according to claim 11, wherein said cage sleeve passage further comprising a larger passage diameter portion and a smaller passage diameter portion, said larger passage diameter extending inward from the entry end of said cage sleeve thereby defining an annular shoulder with said smaller passage diameter, said smaller passage diameter identical to and co-extensively joined to passage diameter of said cage sleeve.

14. The apparatus according to claim 13, wherein said mandrel tip slideably and axially disposed within said larger diameter passage of said cage sleeve, said annular shoulder operative to allow limited rearward linear motion of said mandrel assembly during radial retraction of said roller elements.

15. The apparatus according to claim 11, wherein said retaining ports are equally angularly spaced around circumference of said cage sleeve.

16. The apparatus according to claim 11, wherein said means for retaining said roller elements within said retaining ports of said cage sleeve is defined by utilizing a split spring sleeve, said split spring sleeve mounted on the outer diameter of said cage sleeve between adjacent annular shoulders.

17. The apparatus according to claim 16, wherein said split spring sleeve is further defined as having radially aligned holes around its circumference, said holes having a smaller diameter than that of said roller elements.

18. The apparatus according to claim 17, wherein said radially aligned holes are circumferentially oriented around said split spring sleeve in identical angular spacing to the circumferential spacing of said retaining ports.

19. The apparatus according to claim 18, wherein said spring sleeve holes have radially aligned angular spacing identical to that of said retaining ports on said cage sleeve thereby allowing installation of said split spring sleeve over said retaining ports.

20. The apparatus according to claim 19, wherein said split spring sleeve as angularly installed over said cage sleeve retaining ports permits a range of radial motion of said roller elements positioned within said retaining ports and retained therein by said split spring sleeve.

21. The apparatus according to claim 11, wherein said actuation means for producing linear nonrotational motion of said cage assembly and said mandrel assembly comprises an actuation device coupled to said cage assembly and said mandrel assembly and controlled by said control means.

22. The apparatus according to claim 21, wherein said actuation device for producing linear nonrotational motion of said cage assembly is independent and separate from said actuation device for producing linear nonrotational motion of said mandrel assembly.

23. The apparatus according to claim 22, wherein rolling movement of said spherical rollers along said tapered mandrel tip upon actuation of said mandrel assembly actuation device generates corresponding radial motion proportional to the slope of said tapered surface of said mandrel tip.

24. The apparatus according to claim 23, wherein said radial motion of said roller elements generates pressing contact with inner diameter walls of said tube member, the amplitude of said radial motion defining the depth and width of said groove produced therein.

25. The apparatus according to claim 11, wherein variable linear nonrotational motion of said mandrel assembly during linear nonrotational motion of said cage assembly produces variable groove profile variations.

26. The apparatus according to claim 25, wherein variable linear nonrotational motion of said mandrel assembly translates into variable radial motion of said roller elements thereby developing variable groove impression profiles.

27. The apparatus according to claim 26, wherein said variable groove impression profiles are in the form of proportional groove width and groove depth differences along the groove length.

28. The apparatus according to claim 11, wherein the taper of said mandrel tip is conical.

29. The apparatus according to claim 28, wherein said conical taper of said mandrel tip is further defined as having a minimum diameter at its entry end and a maximum diameter at its end joinably connected to said mandrel shank.

30. The apparatus according to claim 29, wherein said conical taper has a linear slope, said linear slope defining the range of radial motion of said rolling elements.

31. A method of producing grooves on the inner walls of a cylindrical tube, said method comprising the steps of:

positioning said cylindrical tube;

providing a groove forming tool comprising a cylindrical cage sleeve and cage member co-extensively connected to define a cage assembly having a central axial passage extending therethrough, a mandrel shank co-extensively connected to a tapered mandrel tip defining a mandrel assembly slideably disposed with said central passage of said cage assembly, at least one retaining port extending through said cage sleeve, a roller element disposed within said retaining port and rollingly engaging a tapered surface of said mandrel tip, retaining means for retaining said roller element in said retaining port, and first and second actuation means operatively connected independently to said cage member and said mandrel shank respectively for generating linear nonrotational motion of said cage assembly and said mandrel assembly;

actuating said first actuation means to introduce said cage assembly with said mandrel assembly disposed therein into an inner diameter of said cylindrical tube along a common cylindrical axis;

actuating said second actuation means for radially expanding said roller member into rolling contact engagement with said inner diameter of said cylindrical tube to generate a groove impression;

actuating said first actuation means upon engagement of said roller element and said inner tube diameter to provide linear movement of said cage assembly to generate a groove impression of a given length so as to define a groove such that forward actuation of said cage assembly introduces the entry end of said tool into the inner diameter of said cylindrical tube, forward linear actuation of said mandrel assembly produces radial expansion of said spherical balls engaging said conically tapered mandrel tip to create pressing contact of said spherical balls with said cylindrical tube inner walls thereby generating said multiple groove impressions.

32. The method of claim 31, further comprising the step of providing means for selectively controlling actuation of said first and second actuation means, such selective control generating controllable groove profile variability.

33. The method of claim 32, wherein positive location of said cylindrical tube comprises positioning said tube cylindrical axis concentric with, and concurrent to the cylindrical axis of said tool.

34. The method of claim 32, wherein length of actuation of said cage assembly thereby defines the length of the groove impression.

35. The method of claim 32, wherein said means for selectively controlling actuation of said first and second actuation means comprises a controller device for generating reciprocating linear actuation of said mandrel assembly and said cage assembly.

36. An apparatus for automatically producing multiple grooves on the inner wall of cylindrical tubes comprising:

a cylindrical cage member having an internal passage extending through its length, said passage centrally aligned with the cylindrical axis of said cage member;

a cylindrical cage sleeve having an axially aligned passage, said cage sleeve co-extensively connected to said cage member thereby defining a cage assembly having a continuous internal passage therein;

a mandrel shank axially and slideably disposed within said passage of said cage assembly;

a conically tapered mandrel tip co-extensively connected to said mandrel shank to create a mandrel assembly, said mandrel tip axially and slideably disposed exclusively within the central passage of said cage sleeve;

a plurality of retaining ports through said cage sleeve, said retaining ports aligned within the same circumferential plane which is perpendicular to the cylindrical axis of said cage sleeve, said retaining ports being equally angularly spaced around circumference of said cage sleeve;

a plurality of spherical balls, said spherical balls individaully positioned within said retaining ports of said cage sleeve, thereby rollingly engaging said conically tapered mandrel tip disposed within said cage sleeve;

a cylindrical split spring sleeve mounted on the outer diameter of said cage sleeve, said split spring sleeve having circumferentially spaced holes identical in angular orientation with the circumferential spacing of said retaining ports, said spring sleeve retaining said spherical balls within said retaining ports to maintain rolling contact of said spherical balls with said conically tapered mandrel tip;

reciprocating actuation devices, said actuation devices operatively connected individaully to said mandrel assembly and said cage assembly thereby generating linear nonrotational motion of said assemblies; and means for controlling the linear motion generated by said activation devices;

whereby forward actuation of said cage assembly introduces the entry end of said tool into the inner diameter of said cylindrical tube, forward linear actuation of said mandrel assembly produces radial expansion of said spherical balls restingly following said concially tapered mandrel tip which creates pressing contact of said spherical balls into said cylindrical tube inner walls thereby generating said multiple groove impressions.

37. The apparatus according to claim 36, wherein said tool produces multiple groove impressions simultaneously.

38. The apparatus according to claim 37, wherein said simultaneously produced multiple groove impressions have identical geometric profiles, said geometric profiles defined by the width, depth, length, and combinations thereof of said groove impressions.

39. The apparatus according to claim 36, wherein said plurality of retaining ports, spherical rollers and split spring sleeve holes is further defined as consisting of three of each.

40. The apparatus according to claim 36, wherein said equal spacing of said retaining port on said cage sleeve and said split spring sleeve holes is further defined to be 120° angular spacing.

* * * * *

UNITED STATES PATENT AND TRADEMARK OFFICE

CERTIFICATE OF CORRECTION

PATENT NO. : 4,866,966
DATED : September 19, 1989
INVENTOR(S) : Robert A. Hagen

It is certified that error appears in the above-identified patent and that said Letters Patent is hereby corrected as shown below:

TITLE PAGE:

Add as a joint inventor to this patent: Michael G. Gaines, 1414 Heather, Temperance, MI 48182

Col. 3, Line 34, "this" should be --This--;

Col. 4, Line 10, "vibration" should be --vibrations--;

Col. 4, Lines 34-35, "hydrualic" should be --hydraulic--;

Col. 4, Line 63, "a" should be --an--;

Col. 5, Line 29, "which should be --as--;

Col. 7, Line 39, "are" should be --is--;

Col. 7, Line 51, "seciton" should be --section--;

UNITED STATES PATENT AND TRADEMARK OFFICE

CERTIFICATE OF CORRECTION

PATENT NO. : 4,866,966

DATED : September 19, 1989

INVENTOR(S) : Robert A. Hagen

It is certified that error appears in the above-identified patent and that said Letters Patent is hereby corrected as shown below:

Col. 8, Line 36, "communicatin" should be --communication--;

Col. 12, Line 21,"individaully" should be --individually--.

Signed and Sealed this

Second Day of July, 1991

*Attest:*

*Attesting Officer*

HARRY F. MANBECK, JR.

*Commissioner of Patents and Trademarks*